US009277328B2

(12) United States Patent
Akino

(10) Patent No.: US 9,277,328 B2
(45) Date of Patent: Mar. 1, 2016

(54) CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 137 days.

(21) Appl. No.: 14/287,779

(22) Filed: May 27, 2014

(65) Prior Publication Data

US 2015/0003645 A1 Jan. 1, 2015

(30) Foreign Application Priority Data

Jun. 28, 2013 (JP) ..... 2013-136105

(51) Int. Cl.
*H04R 25/00* (2006.01)
*H04R 19/04* (2006.01)
*H04R 1/08* (2006.01)

(52) U.S. Cl.
CPC . *H04R 19/04* (2013.01); *H04R 1/08* (2013.01)

(58) Field of Classification Search
CPC ..... H04R 19/04; H04R 1/04; H04R 9/08; H04R 1/08; H04R 1/342; H04R 19/00; H04R 31/006; H04R 17/02; H04R 19/016; H04R 1/245; H04R 1/2807; H04R 1/2869; H04R 1/326; H04R 23/02; H04R 2410/00; H04R 3/00; H04R 9/025
USPC ..... 381/355, 174, 361, 369, 113, 111, 122, 381/182, 190, 191, 150, 26, 91; 379/433.03
See application file for complete search history.

(56) References Cited

U.S. PATENT DOCUMENTS

2008/0101630 A1* 5/2008 Akino ..... H04R 19/04 381/190
2010/0189298 A1* 7/2010 Akino ..... H04M 1/035 381/356
2012/0014542 A1* 1/2012 Akino ..... H04R 1/406 381/174

FOREIGN PATENT DOCUMENTS

JP 2005-184347 * 7/2005
JP 2005-184347 A 7/2005

* cited by examiner

*Primary Examiner* — Paul S Kim
*Assistant Examiner* — Norman Yu
(74) *Attorney, Agent, or Firm* — Manabu Kanesaka

(57) ABSTRACT

A handheld condenser microphone is provided with a condenser microphone unit having two unidirectional condenser elements. A conductive fabric 221 is put between a lock ring 213 and the second condenser element 10*b*, when an acoustic-electric transducer 220 is fixed inside a unit case 210 by fastening force of the lock ring 213.

4 Claims, 3 Drawing Sheets

CONDENSER MICROPHONE

CROSS-REFERENCE TO RELATED APPLICATION

The present application is based on, and claims priority from, Japanese Application Serial Number JP2013-136105, filed Jun. 28, 2013, the disclosure of which is hereby incorporated by reference herein in its entirety.

TECHNICAL FIELD

The present invention relates to a condenser microphone, more particularly, a handheld condenser microphone having a condenser microphone unit using a diaphragm at a rear acoustic terminal.

BACKGROUND ART

There are condenser microphone units which use diaphragms at rear acoustic terminals (for example, see Patent Literature 1: Japanese Patent Application Publication No. 2005-184347). One example of such condenser microphone units is shown in FIG. 4 and will be described below.

This condenser microphone unit 10 has a basic configuration including a first condenser element 10*a* and a second condenser element 10*b* which are coupled via a coupling ring 22 at the center.

The first condenser element 10*a* and the second condenser element 10*b* have the same configuration. Hereinafter, the first condenser element 10*a* will be mainly described, and reference numerals of the corresponding components of the second condenser element 10*b* will be described in brackets.

The condenser element 10*a* (10*b*) is configured by incorporating a diaphragm supporting member 12*a* (12*b*) over which a diaphragm 11*a* (11*b*) stretches with predetermined tension applied, a spacer ring 13*a* (13*b*), a fixed pole 14*a* (14*b*) and an insulation base 15*a* (15*b*) in this order inside a case 16*a* (16*b*) which is formed in a ring shape so as to have electric insulation.

The diaphragm supporting member 12*a* (12*b*) is formed with a disc body having an acoustic hole for taking in an acoustic wave into the diaphragm 11*a* (11*b*). At a substantially central portion of the diaphragm supporting member 12*a* (12*b*), an electrode lead-out terminal 121 is attached. Although FIG. 4 shows only one acoustic hole, a plurality of acoustic holes 141 are pierced at the fixed pole 14*a* (14*b*).

The insulation base 15*a* (15*b*) is formed in a plate shape with a standing peripheral portion so that an air chamber with a predetermined volume is formed between the insulation base 15*a* (15*b*) and the fixed pole 14*a* (14*b*) and through-holes 152 are pierced at respective centers of the bottom portions. Further, an external thread 151 is formed at an outer periphery surface of the insulation base 15*a* (15*b*).

The first condenser element 10*a* and the second condenser element 10*b* are coupled to each other by the external threads 151, 151 being screwed into internal threads 221 of the coupling ring 22 in a state where the insulation bases 15*a*, 15*b* are placed back-to-back. At this time, an acoustic resistance material 31 which has a larger diameter than those of the through-holes 152 is arranged coaxially with respect to the through-holes 152 between the insulation base 15*a* and the insulation base 15*b*. That is, the through-holes 152 of the insulation bases 15*a*, 15*b* are acoustically connected by the acoustic resistance material 31. It should be noted that a gasket 32 for preventing sound leakage is disposed around the acoustic resistance material 31.

This configuration allows an amount of compression of the acoustic resistance material 31, that is, an acoustic resistance value to be variable according to screw amounts of the insulation bases 15*a*, 15*b* with respect to the coupling ring 22. Accordingly, it is possible to adjust the acoustic resistance value between the diaphragm 11*a* and the diaphragm 11*b* in a state where the first condenser element 10*a* and the second condenser element 10*b* are assembled.

In this condenser microphone unit 10, the condenser elements 10*a* and 10*b* are both unidirectional. Therefore, as described in, for example, Patent Literature 2 (Japanese Patent Application Publication No. H07-143595), it is possible to change directionality by changing a voltage to be applied to each of the condenser elements 10*a*, 10*b*. Further, if the diaphragm 11*a* at the side of the first condenser element 10*a* is used as a front acoustic terminal, the diaphragm 11*b* at the side of the second condenser element 10*b* acts as a rear acoustic terminal.

In the above-described condenser microphone unit 10, the electrode lead-out terminals 121 are attached to the diaphragm supporting members 12*a*, 12*b* of both the first condenser element 10*a* and the second condenser element 10*b* so as to obtain a sound signal. Therefore, because it is difficult to directly apply such a condenser microphone unit to a handheld (mobile) condenser microphone, conventionally, the condenser microphone unit has been only applied to a side-entry type condenser microphone.

Therefore, a problem to be solved by the present invention is to enable application of a condenser microphone unit having two unidirectional condenser elements as described above to a handheld condenser microphone.

SUMMARY OF THE INVENTION

To solve the above-described problem, the present invention provides a handheld condenser microphone including a microphone unit having an electrostatic acoustic-electric transducer inside a unit case, and a unit supporting portion having a cylinder to which the unit case is detachably coupled and a circuit board housed in the cylinder for outputting a sound signal, the unit supporting portion being supported by a microphone chassis, wherein the acoustic-electric transducer includes first and second condenser elements each of which includes a diaphragm stretching over a diaphragm supporting member and a fixed pole having acoustic holes, the diaphragm and the fixed pole being disposed to face each other via a spacer ring, and insulation bases each of which has an opening to contain an acoustic resistance material at a substantially central portion, the insulation bases being disposed between the respective fixed poles of the first and second condenser elements, a conductive fabric having both conductivity and elasticity is provided over an outer face of one of the diaphragm supporting members supporting a diaphragm which serves as a rear acoustic terminal, a relay rod which electrically connects the one of the diaphragm supporting members to the circuit board is provided in the unit supporting portion, and when the unit case is connected to the cylinder, the relay rod contacts the conductive fabric so that the one of the diaphragm supporting members is electrically connected to the circuit board.

According to the present invention, while one of the diaphragm supporting members supporting the side of the diaphragm which serves as the rear acoustic terminal is electrically connected to the circuit board via the relay rod in accordance with connection of the unit case and the cylinder, because the relay rod contacts the diaphragm supporting member via the conductive fabric, stress which may change tension of the diaphragm is not applied to the diaphragm supporting member, so that a directional frequency response does not deteriorate.

Further, the handheld condenser microphone of the present invention further has a lock ring which is mounted inside the unit case and which presses the acoustic-electric transducer from the side of the one of the diaphragm supporting members to fix the acoustic-electric transducer inside the unit case, and the conductive fabric is also placed between the lock ring and the one of the diaphragm supporting members.

Further, because fastening stress to be applied by the lock ring is dispersed by the conductive fabric which is also placed between the lock ring and the diaphragm supporting member, the diaphragm supporting member is not displaced even when the acoustic-electric transducer is fixed with the lock ring, so that the directional frequency response does not deteriorate.

In the present invention, the conductive fabric is preferably also disposed between the relay rod and the circuit board.

By disposing the conductive fabric also between the relay rod and the circuit board, the diaphragm supporting member is stably electrically connected to the circuit board.

Further, the present invention includes an aspect where a cover which acoustically seals an upper face side of the circuit board is provided inside the cylinder of the unit supporting portion and the relay rod airtightly penetrates the cover.

By providing the cover which acoustically seals the upper face side of the circuit board inside the cylinder of the unit supporting portion, it is possible to prevent vibration of the circuit board by an incoming sound wave to thereby eliminate noise caused by the vibration of the circuit board.

DETAILED DESCRIPTION

While an embodiment of the present invention will be described below with reference to FIG. 1 to FIG. 4, the present invention is not limited to this embodiment.

Figure 1:
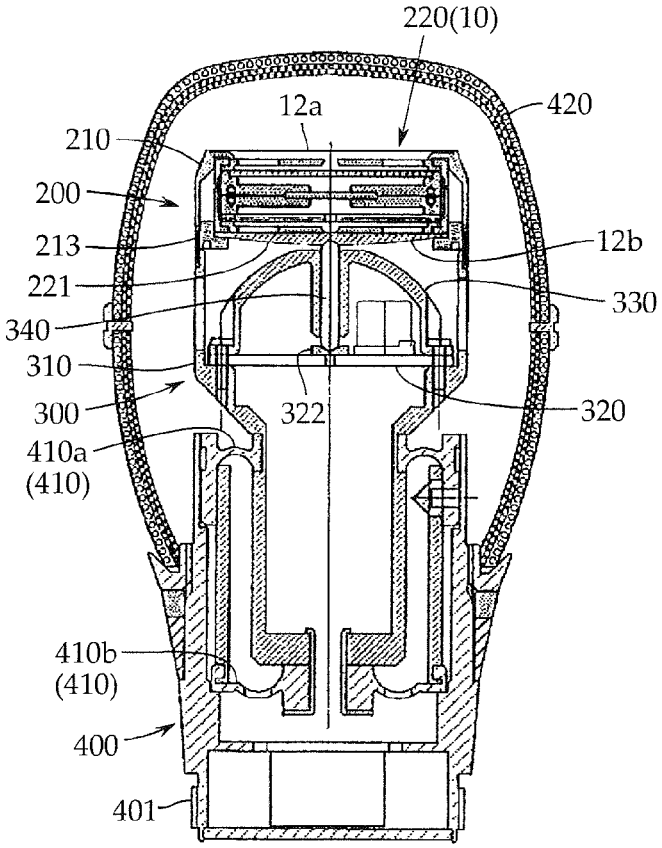
FIG. 1 is a cross-sectional view illustrating a state where a condenser microphone according to an embodiment of the present invention is finally assembled.
Figure 2:
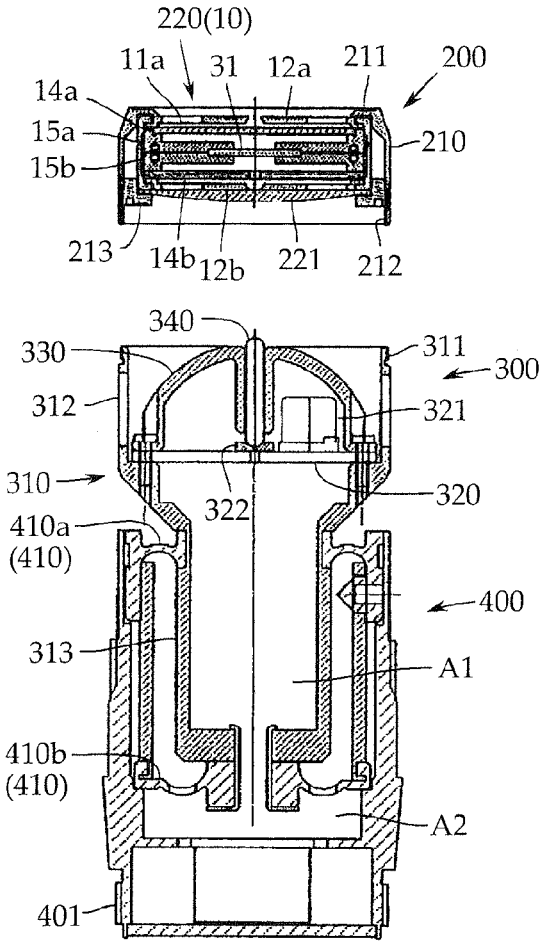
FIG. 2 is a cross-sectional view separately illustrating a microphone unit and a unit supporting portion in the condenser microphone.

As illustrated in FIG. 1 and FIG. 2, a condenser microphone according to this embodiment is a handheld (mobile) condenser microphone which has a basic configuration including a microphone unit 200, a unit supporting portion 300 and a microphone chassis 400.

Figure 3:
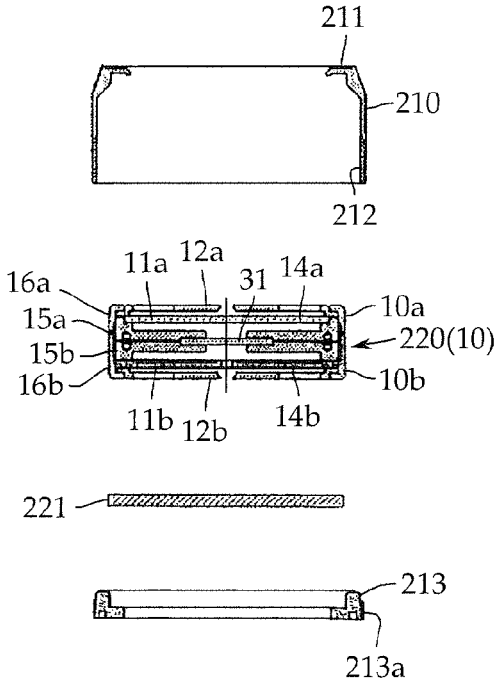
FIG. 3 is an exploded cross-sectional view of the microphone unit in the condenser microphone.

Referring to FIG. 3 in conjunction with FIG. 1 and FIG. 2, the microphone unit 200 includes a unit case 210 which is formed with a metallic material such as aluminum and a brass alloy. The unit case 210 has a cylindrical shape in which a step portion 211 for engagement which projects toward an inner diameter is formed at an anterior end side (at a side facing a sound source when sound is picked up and an upper end side in FIG. 3). Further, the unit case 210 has a posterior end side which has a cylindrical shape and opens, and has an inner periphery surface on which an internal thread 212 is formed.

The unit case 210 houses an electrostatic acoustic-electric transducer 220 inside. In the present invention, the condenser microphone unit 10 of a type which has been described above using FIG. 4 is used as the acoustic-electric transducer 220.

Returning to FIG. 4, the acoustic-electric transducer 220 (10) includes a first condenser element 10*a* and a second condenser element 10*b* which are coupled to each other via a coupling ring 22 at the center.

The first condenser element 10*a* and the second condenser element 10*b* have the same configuration. Hereinafter, the first condenser element 10*a* will be mainly described, and reference numerals of the corresponding components of the second condenser element 10*b* will be described in brackets.

The condenser element 10*a* (10*b*) is configured by incorporating a diaphragm supporting member 12*a* (12*b*) over which a diaphragm 11*a* (11*b*) stretches with predetermined tension applied, a spacer ring 13*a* (13*b*), a fixed pole 14*a* (14*b*) and an insulation base 15*a* (15*b*) in this order inside a case 16*a* (16*b*) which is formed in a ring shape so as to have electric insulation.

The diaphragm supporting member 12*a* (12*b*) is formed with a conductive disc body which has an acoustic hole for taking in an acoustic wave into the diaphragm 11*a* (11*b*) and which also functions as a resonator. Unlike the diaphragm supporting member 12*a* (12*b*) in FIG. 4, the diaphragm supporting member 12*a* (12*b*) itself is used as an electrode terminal plate, and the electrode lead-out terminal 121 is not attached to the diaphragm supporting member 12*a* (12*b*) as illustrated in FIG. 1 to FIG. 3.

It should be noted that because the diaphragm 11*a* (11*b*) stretches over a peripheral portion of the diaphragm supporting member 12*a* (12*b*), when the tension of the diaphragm 11*a* (11*b*) changes by displacement of the diaphragm supporting member 12*a* (12*b*), a directional frequency response deteriorates.

Figure 4:
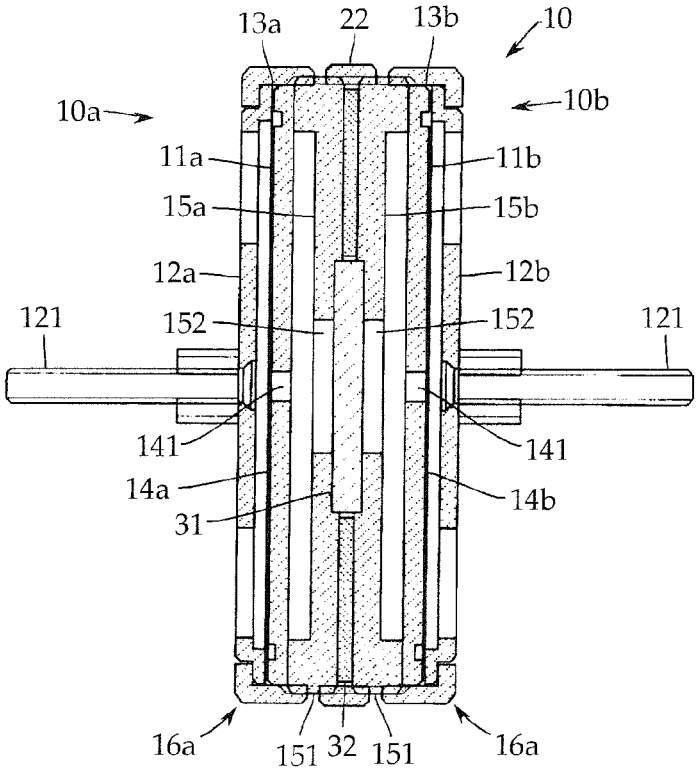
FIG. 4 is a cross-sectional view illustrating a condenser microphone unit using a diaphragm at a rear acoustic terminal.

Although FIG. 4 illustrates only one acoustic hole, a plurality of acoustic holes 141 are pierced at the fixed pole 14*a* (14*b*). The fixed pole 14*a* (14*b*) may be formed with, for example, a porous aluminum material.

The insulation base 15*a* (15*b*) is formed in a plate shape with a standing peripheral portion so that an air chamber with a predetermined volume is formed between the insulation base 15*a* (15*b*) and the fixed pole 14*a* (14*b*). At the respective centers of the bottom portions of the insulation base 15*a* (15*b*), through-holes 152 are pierced. Further, an external thread 151 is formed at an outer periphery surface of the insulation base 15*a* (15*b*).

The first condenser element 10*a* and the second condenser element 10*b* having the above-described configuration are coupled to each other by the external threads 151, 151 being screwed into internal threads 221 of the coupling ring 22 in a state where the insulation bases 15*a*, 15*b* are placed back-to-back. At this time, an acoustic resistance material 31 which has a larger diameter than those of the through-holes 152 is arranged coaxially with respect to the through-holes 152 between the insulation base 15*a* and the insulation base 15*b*.

As described above, the through-holes 152 of the insulation bases 15*a*, 15*b* are acoustically connected by the acoustic resistance material 31. At this time, a gasket 32 for preventing sound leakage is preferably disposed around the acoustic resistance material 31 in order to prevent sound leakage between the insulation bases 15*a*, 15*b*.

This configuration allows an amount of compression of the acoustic resistance material 31, that is, an acoustic resistance value to be variable according to screw amounts of the insulation bases 15*a*, 15*b* with respect to the coupling ring 22. Accordingly, it is possible to adjust the acoustic resistance value between the diaphragm 11*a* and the diaphragm 11*b* in a state where the first condenser element 10*a* and the second condenser element 10*b* are assembled.

It should be noted that the insulation bases 15*a*, 15*b* may be integrally formed, in which case, the coupling ring 22 at the center is not necessary, and the condenser elements 10*a*, 10*b* may be assembled to the integrated insulation bases via the respective cases 16*a*, 16*b*.

In this way, when the first and second condenser elements 10*a*, 10*b* are provided, if a diaphragm of one of the condenser elements is used as the front acoustic terminal, a diaphragm of the other condenser element serves as the rear acoustic terminal.

In this embodiment, in the acoustic-electric transducer 220, because the first condenser element 10*a* is disposed at an anterior end side of the unit case 210 and the second condenser element 10*b* is disposed at a posterior end side of the unit case 210, the diaphragm 11*b* of the second condenser element 10*b* serves as the rear acoustic terminal.

The acoustic-electric transducer 220 is fixed inside the unit case 210 by fastening force of the lock ring 213 loaded to the posterior end portion of the unit case 210.

In this embodiment, the lock ring 213 is formed to have an L-shaped cross-section which supports the side of the case 16*b* of the second condenser element 10*b*. The outer periphery surface of the lock ring 213 is formed with a metallic external thread ring having an external thread 213*a* which is screwed into the internal thread 212. The fastening force of the acoustic-electric transducer 220 can be adjusted by a turning amount of the lock ring 213.

When the acoustic-electric transducer 220 is fixed with the lock ring 213, the diaphragm supporting member 12*a* of the first condenser element 10*a* tightly contacts the step portion 211 for engagement. By this contact, a sound signal of the first condenser element 10*a* is taken out from the diaphragm supporting member 12*a* via the unit case 210.

In contrast to this, because the lock ring 213 is made from metal and the case 16*b* of the second condenser element 10*b* is formed with an electrical insulating material, the second condenser element 10*b* is non-conductive with the unit case 210.

The unit supporting portion 300 includes a cylinder 310 formed with a metallic material. A circuit board 320 is disposed inside the cylinder 310. Though not illustrated in detail, a sound signal output section 321 including an FET (Field-Effect Transistor), or the like, as an impedance converter is implemented at the circuit board 320.

An external thread 311 which is screwed into an internal thread 212 of the unit case 210 is formed at an upper end of the cylinder 310, and the unit case 210 (microphone unit 200) is detachably coupled to the cylinder 310. Further, an opening 312 for taking in a sound wave to the rear acoustic terminal of the acoustic-electric transducer 220 as a rear sound source is pierced at an upper end side on the side face of the cylinder 310.

A cover 330 which acoustically seals the upper face side of the circuit board 320 is provided inside the cylinder 310 so that the circuit board 320 does not cause vibration (particularly, micro vibration) by the sound wave taken in from the opening 312. When the circuit board 320 vibrates, a sound output signal may include noise.

In this embodiment, the cover 330 has a dome shape and a relay rod 340 penetrates through the central portion of the cover 330. When the unit case 210 is coupled to the cylinder 310, the relay rod 340 electrically connects the diaphragm supporting member 12*b* of the second condenser element 10*b* and the circuit board 320.

The cylinder 310 integrally includes a cylindrical base portion 313 having a small diameter, which is inserted inside a microphone chassis 400 at a lower potion (a portion lower than the circuit board 320) of the cylinder 310. The cylinder 310 is elastically held by the microphone chassis 400 at a portion of the cylindrical base portion 313 via vibration reducing means 410.

In this embodiment, the vibration reducing means 410 includes two shock mounts of a first shock mount 410*a* which supports an upper end side of the cylindrical base portion 313 and a second shock mount 410*b* which supports a lower end side of the cylindrical base portion 313. Both the shock mounts 410*a*, 410*b* are comprised of a disc body having rubber elasticity.

Further, as illustrated in FIG. 1 and FIG. 2, an air chamber A1 inside the cylindrical base portion 313 is in communication with an air chamber A2 inside the microphone chassis 400 so as to reduce the impact in a direction of a sound pickup axis upon drop impact.

It should be noted that in this embodiment, an external thread 401 is formed at a lower end of the microphone chassis 400. When the condenser microphone is practically used as a product, a microphone grip (preferably, a microphone grip having an output connector) which is not illustrated is coupled via the external thread 401.

According to this embodiment, by coupling the microphone unit 200 to the unit supporting portion 300 via the internal thread 212 of the unit case 210 and the external thread 311 of the cylinder 310, a sound signal at a side of the first condenser element 10*a* inside the microphone unit 200 is input to one of the input terminals (not shown) of the circuit board 320 from the diaphragm supporting member 12*a* via the unit case 210 and the cylinder 310.

Meanwhile, a sound signal at a side of the second condenser element 10*b* is input to the other input terminal (not shown) of the circuit board 320 via the diaphragm supporting member 12*b* and the relay rod 340 as a system different from the above-described system.

Accordingly, according to this embodiment, it is possible to apply the condenser microphone unit 10 having two unidirectional condenser elements 10*a*, 10*b* illustrated in FIG. 4 to a handheld condenser microphone as an electrostatic acoustic-electric transducer 220 in the present invention by downsizing the condenser microphone unit 10 without substantially changing the basic configuration.

By the way, in the above-described embodiment, when the acoustic-electric transducer 220 is fixed inside the unit case 210, the diaphragm supporting member 12*b* at the side of the second condenser element 10*b* is fastened with the lock ring 213. This fastening stress may cause the diaphragm supporting member 12*b* to be distorted and displaced, which may change the tension of the diaphragm 11*b* and may deteriorate the directional frequency response.

In the same way, when the relay rod 340 abuts on the diaphragm supporting member 12*b* at the side of the second condenser element 10*b*, the diaphragm supporting member 12*b* is distorted and displaced according to the abutting force, which changes the tension of the diaphragm 11*b* and deteriorates the directional frequency response. Particularly, because the relay rod 340 abuts on the central portion of the diaphragm supporting member 12*b*, the diaphragm supporting member 12*b* easily deforms.

Accordingly, in the present invention, as illustrated in FIG. 3, a conductive fabric 221 is provided along an outer face (a lower face in FIG. 3) of the diaphragm supporting member 12*b* at the side of the second condenser element 10*b* so as to preferably cover the entire outer face.

The conductive fabric 221 which is also referred to as a conductive non-woven fabric, is a functional composite material having both flexibility of fiber and conductivity of metal, and is, for example, product number Su-80-705 manufactured by Seiren Co., Ltd.

With this material, when the acoustic-electric transducer 220 is fixed inside the unit case 210 by the fastening force of the lock ring 213, the conductive fabric 221 is put between the lock ring 213 and the second condenser element 10*b*, and stress to be applied to the acoustic-electric transducer 220 is dispersed by its elastic force.

Therefore, it is possible to prevent deformation of the diaphragm supporting member 12*b* by the fastening force of the lock ring 213 upon assembly of the microphone unit 200 and change of the tension of the diaphragm 11*b* at the side of the rear acoustic terminal due to this deformation.

Further, when the microphone unit 200 is coupled to the unit supporting portion 300 by the unit case 210 being screwed into the cylinder 310, the relay rod 340 contacts the conductive fabric 221. However, because the relay rod 340 does not directly contact the diaphragm supporting member 12*b* of the second condenser element 10*b*, even when the unit case 210 is strongly screwed into the cylinder 310, it is possible to prevent change of the tension of the diaphragm 11*b* at the side of the rear acoustic terminal due to deformation of the diaphragm supporting member 12*b*.

It should be noted that by placing a conductive fabric 322 also between the relay rod 340 and the circuit board 320, it is possible to realize more stable electric connection between the diaphragm supporting member 12*b* and the circuit board 320. Because an electric resistance value of the conductive fabrics 221, 322 is in the order of several ohms, the conductive fabrics can be used without causing any problem on a circuit design.

As described above, according to the present invention, when the condenser microphone unit having two unidirectional condenser elements is applied to the handheld condenser microphone, it is possible to assemble the microphone unit and couple the microphone unit (replace the microphone unit) to the unit supporting portion without particularly concerning for change of the tension of the diaphragm which serves as the rear acoustic terminal.

The invention claimed is:

1. A handheld condenser microphone comprising:

a microphone unit having an electrostatic acoustic-electric transducer inside a unit case;

a unit supporting portion having a cylinder to which the unit case is detachably coupled and a circuit board housed in the cylinder for outputting a sound signal, the unit supporting portion being supported by a microphone chassis, wherein the acoustic-electric transducer comprises:

first and second condenser elements each of which includes a diaphragm stretching over a diaphragm supporting member and a fixed pole having acoustic holes, the diaphragm and the fixed pole being disposed to face each other via a spacer ring; and insulation bases each of which has an opening to contain an acoustic resistance material at a substantially central portion, the insulation bases being disposed between the respective fixed poles of the first and second condenser elements, a conductive fabric having both conductivity and elasticity is provided over an outer face of one of the diaphragm supporting members supporting a diaphragm which serves as a rear acoustic terminal, a relay rod which electrically connects the one of the diaphragm supporting members to the circuit board is provided in the unit supporting portion, and when the unit case is connected to the cylinder, the relay rod contacts the conductive fabric so that the one of the diaphragm supporting members is electrically connected to the circuit board.

2. The condenser microphone according to claim 1, further comprising a lock ring which is mounted inside the unit case and which presses the acoustic-electric transducer from the side of the one of the diaphragm supporting members to fix the acoustic-electric transducer inside the unit case, wherein the conductive fabric is also placed between the lock ring and the one of the diaphragm supporting members.

3. The condenser microphone according to claim 1, wherein a conductive fabric is also disposed between the relay rod and the circuit board.

4. The condenser microphone according to claim 1, wherein a cover which acoustically seals an upper face side of the circuit board is provided inside the cylinder of the unit supporting portion, and the relay rod airtightly penetrates the cover.

* * * * *